US011293200B2

(12) United States Patent
Andersen

(10) Patent No.: US 11,293,200 B2
(45) Date of Patent: Apr. 5, 2022

(54) SAFETY GATE

(71) Applicant: Safe and Care Ltd., Kowloon (CN)

(72) Inventor: Jesper Birk Andersen, Kowloon (CN)

(73) Assignee: SAFE AND CARE LTD., Kowloon (CN)

( * ) Notice: Subject to any disclaimer, the term of this patent is extended or adjusted under 35 U.S.C. 154(b) by 1029 days.

(21) Appl. No.: 15/951,440

(22) Filed: Apr. 12, 2018

(65) Prior Publication Data

US 2019/0032372 A1 Jan. 31, 2019

(30) Foreign Application Priority Data

Jul. 28, 2017 (GB) ..... 1712169
Dec. 5, 2017 (GB) ..... 1720293

(51) Int. Cl.
*A47B 88/50* (2017.01)
*E05B 65/00* (2006.01)
*E05B 65/46* (2017.01)

(52) U.S. Cl.
CPC ..... *E05B 65/0014* (2013.01); *A47B 88/50* (2017.01); *E05B 65/46* (2013.01)

(58) Field of Classification Search
CPC ..... E05B 65/0014; E05B 65/46; E05B 65/44; A47B 88/50; E05C 19/00; E05C 17/14
(Continued)

(56) References Cited

U.S. PATENT DOCUMENTS 4,139,249 A 2/1979 Hillman
5,626,372 A 5/1997 Vogt
(Continued)

FOREIGN PATENT DOCUMENTS

GB 2495165 A 4/2013

*Primary Examiner* — Kristina R Fulton
*Assistant Examiner* — Thomas L Neubauer
(74) *Attorney, Agent, or Firm* — Fay Sharpe LLP

(57) ABSTRACT

The invention relates to a child safety latch for limiting movement of a first element with respect to a second element, comprising a prong assembly secured to the second element, said prong assembly including a prong arm with a terminal end;

a receiving means secured to the first element for capturing the terminal end of said prong, to stop movement of the first element with respect to the second element by a specified distance from the second element; by automatic engagement of the receiver of the receiving means with the terminal. The prong arm being movable by a user between a first position in which the terminal end is captured by the receiver preventing movement of the first element with respect to the second element and a second position in which the terminal end is released from the receiver permitting movement of the first element with respect to, and further away from, the second element; in a way that the prong arm is resilient and returns to the first position after release by the user such that when the first element is moved back towards the second element, the latch is automatically reactivated such that subsequent movement of the first element away from the second element by the specified distance will result in re-engagement of the terminal end and the receiver. Secondary lock means is provided which is biased to a locked position in which it prevents movement of the prong arm by the user until the secondary lock means is first moved by the user to an unlocked position.

15 Claims, 8 Drawing Sheets

(58) Field of Classification Search
USPC ..... 292/340, 341.18, 341.12, 341.15
See application file for complete search history.

(56) References Cited

U.S. PATENT DOCUMENTS

| | | | | |
|---|---|---|---|---|
| 7,044,509 | B2 * | 5/2006 | Radel | E05B 63/128 292/106 |
| 10,837,202 | B2 * | 11/2020 | Andersen | E05B 65/46 |
| 2005/0134056 | A1 | 6/2005 | Dionysian et al. | |
| 2011/0173895 | A1 | 7/2011 | Lund et al. | |

* cited by examiner

SAFETY GATE

CROSS-REFERENCE TO RELATED APPLICATIONS

This application claims priority to, and the benefit of, Great Britain Patent Application No. GB 1712169.0, filed Jul. 28, 2017; this application also claims priority to, and the benefit of, Great Britain Patent Application No. GB1720293.8, filed Dec. 5, 2017, the entirety of which applications are hereby incorporated by reference as if fully set forth herein.

The present invention relates to latches for drawers, cabinet doors and the like, and, more particularly, to safety latch fittings or "child-proof" latches that include features which make them difficult to be actuated by small children.

BACKGROUND OF THE INVENTION

Drawers are commonly used in daily life in kitchens, bedrooms, offices, etc. to store a wide range of articles, some of which may be harmful to children. Small children may also attempt to climb on, or even in, drawers and cabinets in an effort to play or hide, or retrieve contents from inside. Drawers and cabinets may store many types of materials which may be potentially hazardous to children such as medicines, household cleaners, knives, tools, paint, etc.

To prevent young children from accessing these storage areas, numerous devices have been patented and sold, most of a multi-piece assembly. Generally, a particular type of additional child safety latch has become popular which includes some sort of a longitudinal member with an opening or hook portion and a separate stop portion which are respectively attached to the cabinet frame and inside surface of a drawer or door respectively, or vice versa, to limit the amount the drawer or door may be opened. The hook portion may engage with a stop installed on a frame portion of the cabinet as the drawer or door is withdrawn so that only a small space then remains for an adult to insert their finger to depress the longitudinal member such that the hook may clear the stop on the frame of the enclosure.

In many cases, these latches require at least two components, which need alignment during installation or adjustment after installation. These components generally include a stop portion, or catch, attached to the enclosure and a hook portion attached to the inside of the drawer. This mechanism may further require a biasing member (springs, etc.) to bias the hook member against the stop member.

In one known drawer catch as disclosed in U.S. Pat. No. 4,505,526, a flexible hooked element is mounted to and projects rearwardly from a front wall of a drawer into the interior thereof. The hooked element is positioned to engage a catch on a downward facing surface of the cabinet which overlies the drawer. The drawer can be opened a limited amount until the hook engages the catch, at which time the user must manually flex the hook downwardly to disengage the catch. In this arrangement, the hook extends into the interior of the drawer such that it may interfere with access to the drawer interior as well as interfere with the contents thereof.

What is needed is a "child-proof" safety latch that is easy to install on the inside surface of a drawer, or door, and which are sufficiently difficult for a child to operate to gain access. Thus, a drawer, or cabinet door, may only be partially opened and its contents kept secure from children. Upon actuation of the more than one action by an adult, the contents may become accessible.

One way of making it more difficult for a child to operate the latch is to increase the force required to move the latch. The force required to move the latch can be designed into the latch and specified in a range that is achievable by most adults but not achievable by small children, thus achieving an effective child proof latch. The disadvantage with relying on force however is that latches are typically made of plastic and with continued use over many operations of releasing the latch, the plastic components may creep and the tolerances of the release point of the hook and stop of the latch may change over time an result in the force required becoming less over time and at come, undetermined point in time the latch can become unsafe.

For the ease of fitting of the latch components of the hook and the stop it is preferable to attach them to the respective surfaces of the drawer or door and cupboard frame by means of adhesive, and preferably by means of a pre-dimensioned peelable adhesive strip so that a lay person can easily fit the latch without the need for tools, that would be required if the latch components were secured by means of screws.

Similarly latches that rely on force to release them carry the risk that the adhesive strip will not hold, in particular after repeated use over an extended period of time.

It is thus an object of the present invention to provide a child safety latch which may preferably be moulded of plastic to provide a low cost safety latch and which overcomes the above problems.

There is now described an exemplary embodiment of the child safety latch mechanism of the present invention with reference to the following drawings:

DETAILED DESCRIPTION

Figure 1:
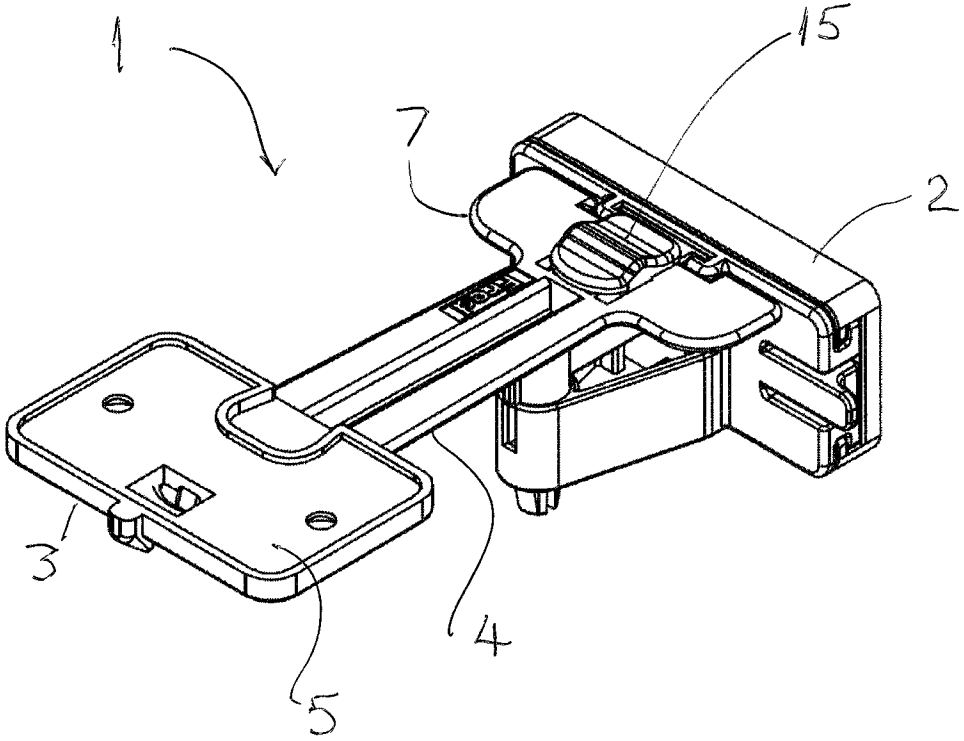
FIG. 1 shows a perspective view of an exemplary embodiment of the assembled child safety latch of the invention.
Figure 2:
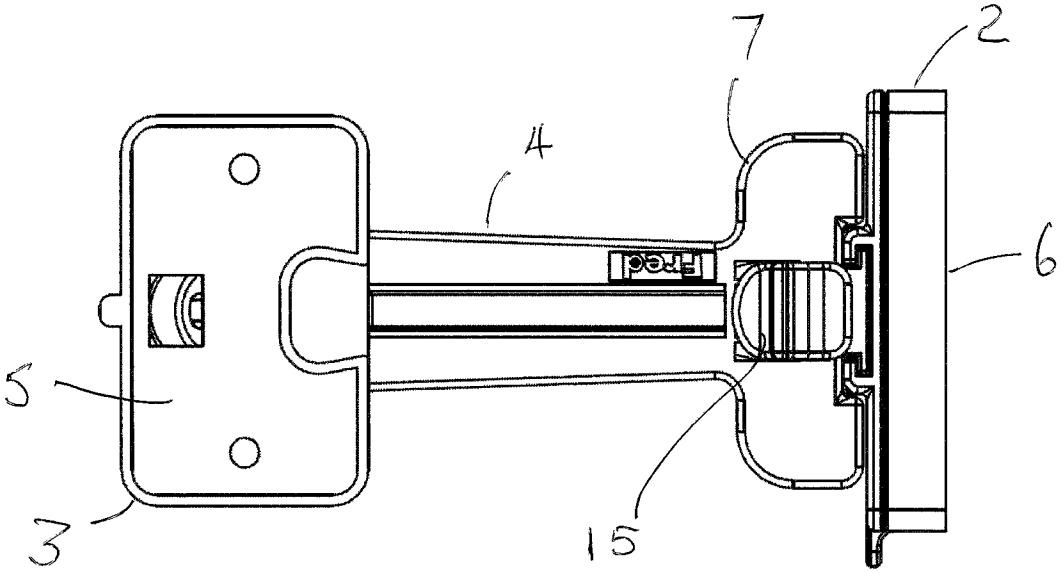
FIG. 2 shows a top view of the child safety latch of FIG. 1.
Figure 3:
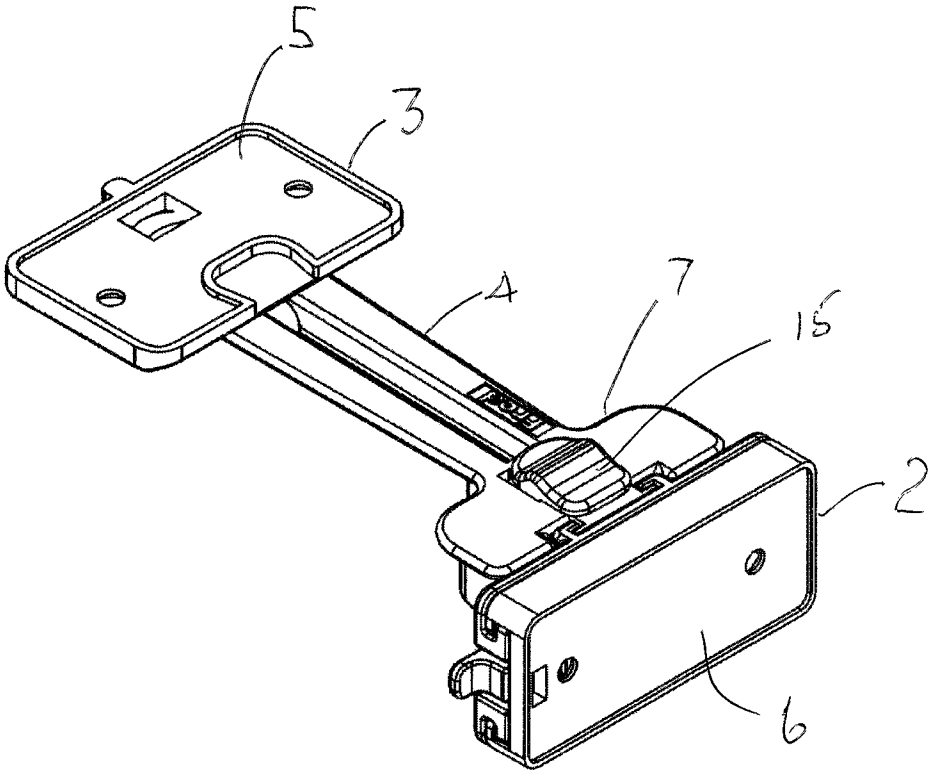
FIG. 3 shows a top perspective view of the child safety latch of FIG. 1.
Figure 4:
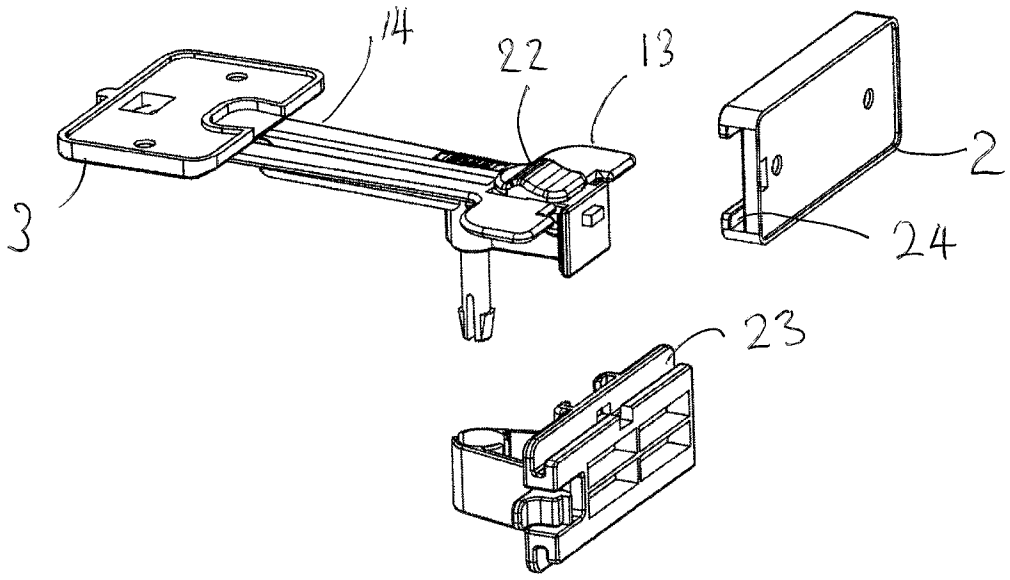
FIG. 4 shows the top perspective view of FIG. 1 with the components of the latch shown unassembled, with the springs not shown.
Figure 5:
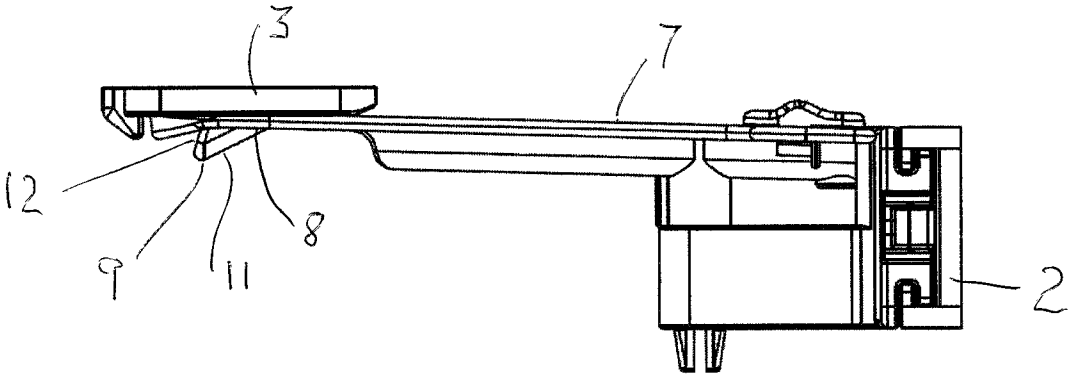
FIG. 5 shows a side view of the assembled child safety latch of FIG. 1.
Figure 6:
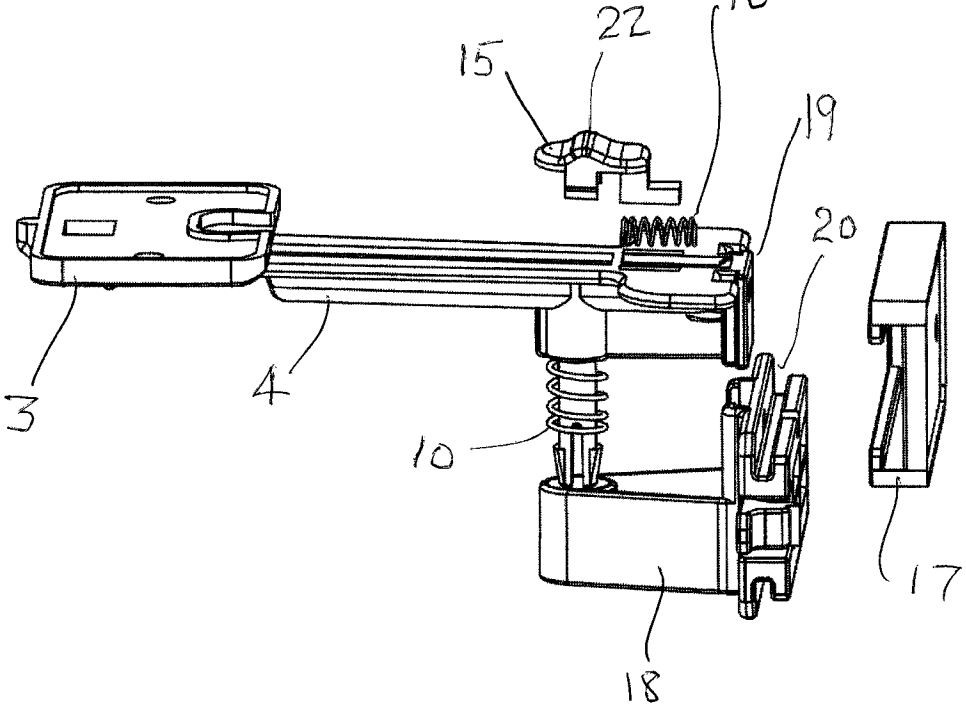
FIG. 6 shows a perspective view of the child safety latch of FIG. 1, with the components shown unassembled showing the springs.

The present invention is described more fully hereinafter with reference to the accompanying drawings, in which preferred embodiments of the invention are shown. This invention, may, however, be embodied in many different forms and should not be construed as limited to the embodiments set forth herein; rather, these embodiments are provided so that this disclosure will be thorough and complete, and will fully convey the scope of the invention to those skilled in the art.

Referring now to FIGS. 1-6, a first exemplary embodiment of a childproof latch mechanism according to the present invention is described. The latching mechanism is attachable to the inner surface of a cupboard drawer or door to restrict the amount that the drawer may be easily opened to a specified distance up to a maximum of 30 mm. The child safety latch 1 thus limits the movement of a first drawer or door element (not shown) with respect to a second cabinet frame element (not shown). The latch fitting mechanism 1 includes a first latch fitting 2 and a second latch fitting 3. Holes are provided in the first latch fitting 2 and the second latch fitting 3 for attachment to the inside surface of a side of the drawer or cupboard with mechanical fasteners, such as screws. However it is preferable that double sided adhesive tape is used preferably provided already adhered to the upper surface 5 of the second latch fitting 3 and the outer surface 6 of the first latch fitting 2 fitting with a peel-off strip so the user may simply remove the strip and press the latch fitting in the desired location to fit it. Hook-and-loop type fasteners, such as Velcro® may also be used.

The first latch fitting 2 includes a cantilever prong arm member 4 with an elongate arm and a hollow or holed section 8 at its remote end, and is preferably, but not limited to, being moulded of a resilient plastic. The second latch fitting 3 includes a protrusion or receiving peg 9 for engaging with the holed section 8 of the prong arm 4 such that when they are engaged, the latching member 1 holds the drawer front or door relative to the cabinet frame so that it does not open by more than 30 mm.

The first and second latch fittings 2, 3 are secured to the first element and second element by means of suitable fixing means such as adhesive or Velcro. These means are easy for the user to use without the need for additional tools such as a screw driver. Although screw holes are provide and it is an option for the user to use screws, by means of the secondary lock of the present invention operation of the latch and opening of the cupboard drawer or door is sufficiently difficult for a child without the need for the latch to be designed to require an adult to exert any significant force on the latch in order to operate. This is typically achieved by deploying a spring with a large resilient force which a child would have greater difficulty in operating but which would require the adult to exert a greater force each time the latch was operated. The latch of the invention being not subject to successive large forces during repeated opening by an adult user, but instead being subject to much smaller forces, but instead with the requirement being for the smaller forces in a particular direction can be successfully, can be reliably secured to the cabinet by means of adhesive or Velcro and the need for screw fittings is avoided.

The second latch fitting 3 includes a receiving peg 9 to receive and capture the terminal hole section 8 which stops movement of the first element with respect to the second element.

The movement of the first element with respect to the second element is stopped when the first element has moved a specified distance from the second element; by automatic engagement of the receiving end 9 of the second latch fitting 3 with the terminal hole section 8. The specified distance being approximately the length of the prong assembly 7.

The prong assembly 7 forms a cantilever prong arm 4 and is movable by a user between a first position in which the terminal hole section 8 is captured by the receiving peg 9 preventing movement of the first element with respect to the second element and a second position in which the terminal hole 8 is released from the receiving peg 9 permitting movement of the first element with respect to, and further away from, the second element.

The prong arm 4 is resilient by means of prong spring 10 and returns to the first position after release by the user such that when the first element is moved back towards the second element, the latch is automatically reactivated such that subsequent movement of the first element away from the second element by the specified distance will result in re-engagement of the terminal hole 8 and the receiving peg 9.

The terminal hole 8 of the prong assembly 7 includes an oval shaped opening which corresponds with the receiving peg 9. The receiving peg 9 is in the form of a ramp shaped catch on the second latch fitting 3 with a shallowly inclined ramp 11, an acute-angled return edge 12. As the first element is moved away from the second element, as would happen when opening a drawer or door, the prong assembly 7 and the anchor assembly are so aligned when fitted that the front portion of the prong arm 4 follows the inclined ramp 11. The resiliency of the prong assembly 7 causes the front portion to ride over the shallow inclined ramp 11 allowing the door or drawer to close normally.

The prong arm 4 is elongate and preferably moulded of plastic material comprising a first leg 13 which is attached to the first element and a second leg 14 comprising the terminal end. The first leg 13 in turn supports a secondary lock 15 which is biased to a locked position in which it prevents the downward movement of the prong assembly 7 by the user until the secondary locked is first moved by the user to an unlocked position.

The secondary lock 15 is biased to the locked position by a resilient lock spring 16 such that the user may push the secondary lock 15 against the lock spring 16, in an inward direction, with respect to the cupboard, so from right to left in the figures, to release the prong arm 4 for downward movement to its second position. The lock spring 16 automatically restores the secondary lock 15 to the locked position when released.

The resilient prong spring means 10 is approximately arranged between the first leg 13 and the second leg 14 of the prong assembly 7.

The first latch fitting 2 comprises fixed support means 17 which are fixedly attached to the first element and prong support means 18 which provide support for the prong spring 10 and a guide 19 which corresponds to guide means 20 on the prong assembly 7 which support the prong assembly 7 and permit up and down movement of the prong arm 4.

In the locked position the secondary lock 15 braces against a locking surface on the prong support means 18 preventing downward movement of the prong arm 4 and in the unlocked position the secondary lock is moved free of the locking surface so the elongate prong arm 4 may be moved from its first position to its second position.

The secondary lock is slidably movable from the locked position to the unlocked position against the action of the lock spring 16 in a horizontal direction from right to left in the figures, whereas the elongate prong then needs to be moved in a second vertical downward direction. This required sequence of movement in distinctly different directions is key to the child safety performance of the latch.

The secondary lock 15 includes a digit engaging surface 22 for engagement by the user.

Referring now to FIGS. 7-12, a further exemplary embodiment of a childproof latch mechanism according to the present invention is described. The latching mechanism is similarly attachable to the inner surface of a cupboard drawer or door to restrict the amount that the drawer may be easily opened to a specified distance up to a maximum of 30 mm. The latch fitting mechanism 101 includes a first latch fitting 103 and a second latch fitting 102.

The first latch fitting 103 includes a cantilever prong arm member 104 with an elongate arm and a hollow or holed section 108 at its remote end, and is preferably, but not limited to, being moulded of a resilient plastic. The second latch fitting 102 includes a protrusion or receiving peg 109 for engaging with the holed section 108 of the prong arm 104 such that when they are engaged, the latching member 101 thus holds the drawer front or door relative to the cabinet frame so that it does not open by more than 30 mm.

The second latch fitting 102 which includes the receiving peg 109 to receive and capture the terminal hole section 108 also stops movement of the first element with respect to the second element.

The movement of the first element with respect to the second element is stopped when the first element has moved a specified distance from the second element; by automatic engagement of the receiving end 109 of the second latch fitting 102 with the terminal hole section 108. The specified distance being approximately the length of the prong arm 104.

The prong arm 104 forms a cantilever and is movable by a user between a first position in which the terminal hole section 108 is captured by the receiving peg 109 preventing movement of the first element with respect to the second element and a second position in which the terminal hole 108 is released from the receiving peg 109 permitting movement of the first element with respect to, and further away from, the second element.

Figure 7:
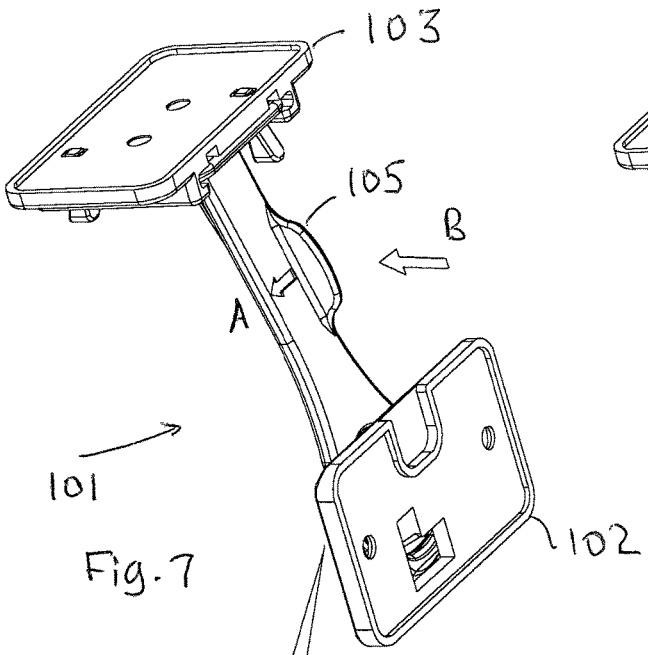
FIG. 7 shows a perspective view of a further exemplary embodiment of the assembled child safety latch of the invention.
Figure 8:
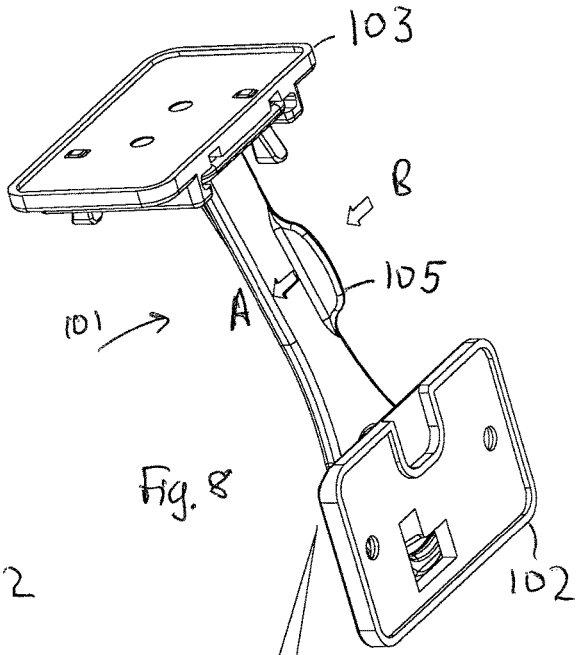
FIG. 8 shows a perspective view of the embodiment of FIG. 7 showing a second position.
Figure 9:
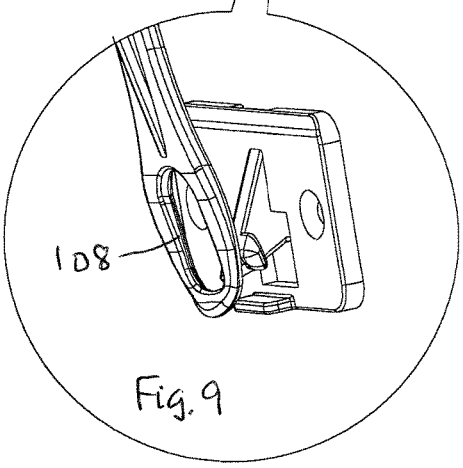
FIG. 9 shows an enlarged perspective view of an end of a prong of the embodiment of FIG. 7.
Figure 10:
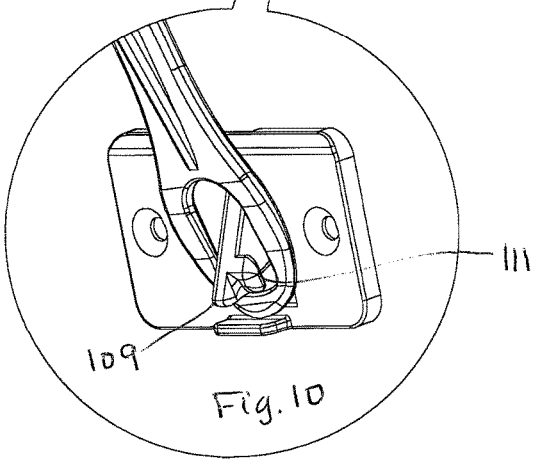
FIG. 10 shows an enlarged view of the prong in an alternative position.
Figure 11:
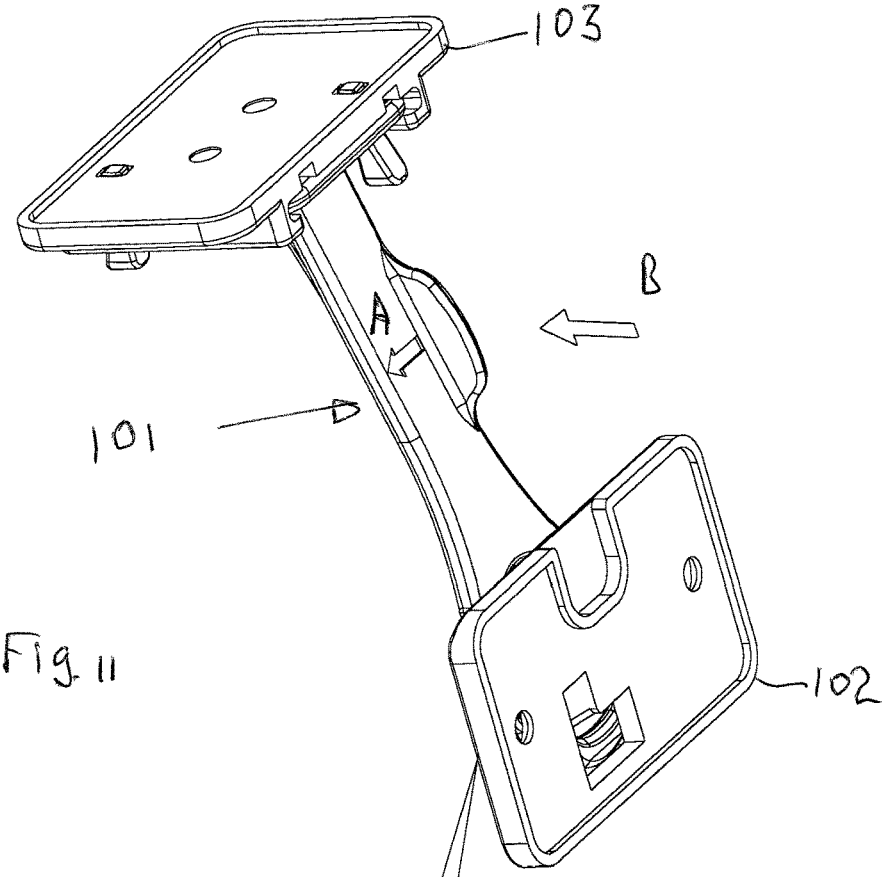
FIG. 11 shows a further perspective view of the embodiment of FIG. 7.
Figure 12:
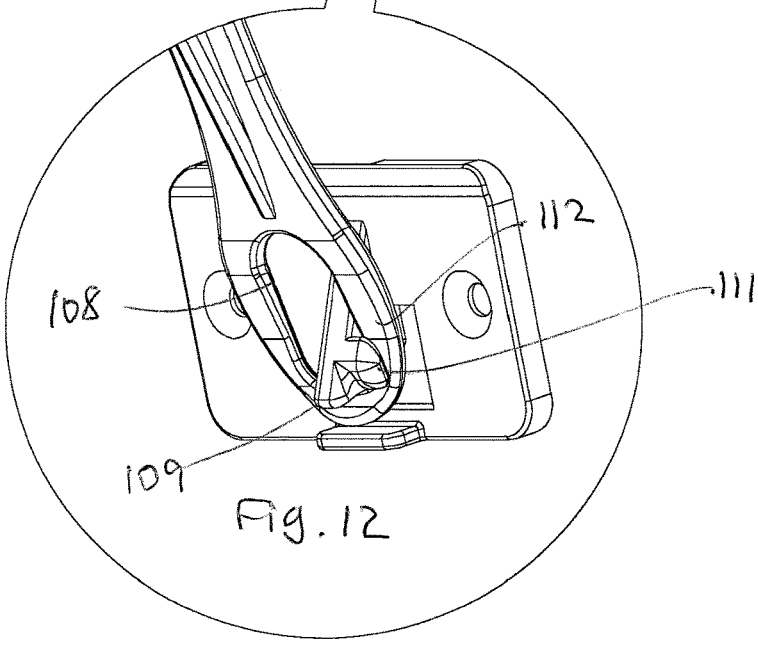
FIG. 12 shows an enlarged perspective view of the end of the prong of FIG. 11.

To release the holed section 108 from the peg 109 the prong arm must be movement downwardly, in the direction of arrow A in FIGS. 7, 8 and 11. However this downward movement in the direction of arrow A is prevented by a lateral tongue extension 111 on the receiving end 109 which engages against the underside of one side 112 of the terminal hole section 108 as shown in FIG. 12. Therefore a first movement of the prong arm 104 in a sideways direction in the direction of Arrow B as shown in FIGS. 7, 8 and 11 is required by the user to move the terminal hole 108 sideways to move one side 112 out of alignment with the tongue extension 11 as shown in FIG. 10. This releases the arm 104 for subsequent downward movement in the direction of Arrow A to release the peg from the holed section 108 as shown in FIG. 9, so the draw or cupboard door may be opened.

The prong arm 104 is resilient and returns to the first position after release by the user such that when the first element is moved back towards the second element, the latch is automatically reactivated such that subsequent movement of the first element away from the second element by the specified distance will result in re-engagement of the terminal hole 108 and the receiving peg 109 and the tongue 111 will automatically engage under the holed section 108 in line with the one side 112.

This forms an effective secondary lock and requires two separate movements on the part of the user in approximate orthogonal direction in order to release the latch 101. Thus the degree of difficulty is sufficient to be difficult for a child to operate and yet possible for an adult. Furthermore this two action release means that the lock is still child proof even if the force required to move the prong arm 104 in each direction is relatively modest, such as 20 Newtons each, so that the lock can be released by adults without the need to exert a larger force. Single action release lock required a larger minimum force of 50 Newtons to effectively be child resistant and these locks are sometimes difficult to release by adults who are not able to exert such a high force easily.

The prong arm 104 includes a digit engaging protrusion 105 including a digit engaging surface for engagement by the user and to enable the user, and to also indicate to the user to move the arm 104 firstly sideways in the direction of Arrow A and subsequently downwardly in the direction of arrow B to release the latch.

The fitting of the latch is made easy for the user so that lay person can easily fit the latch without the need for prior knowledge, training or tools. The fixed support means are secured to the first element in the desired position by removing the peelable strip from the adhesive strip of the attaching surface 6 and then pressing the attaching surface of the fixed support means. The prong support means, with the prong assembly arranged thereon, is then fitted to the fixed support means against the surface of the first element in the desired location. They are fitted together using a corresponding groove 23 and guide means 24. In this way the user can mark the desired relative positions of the first and second latch fittings so that they are in the correct alignment and spacing from each other.

During use, the secondary lock is engageable by the user and slidably moved in a first step to release the prong arm 4 and the prong assembly 7 is arranged to then be free to be moved in a downward direction to release the terminal hole 8 from the receiving peg 9 and permit the second element to be movement with respect to the first element.

The latch may be a cabinet latch with the first element part of a cabinet frame and the second element a cabinet door, or alternatively the latch may be a drawer latch and the first element part of the drawer chest frame and the second element a drawer.

Thus, a childproof latch is provided which may be easily installed on the inside of a closure member without power tools or the need to measure. The latch may allow partial opening of the closure member but requires an additional actions to be carried out so that the enclosure which the member closes may be freely accessed.

It should be understood that although specific embodiments of the present invention have been described herein in detail, such descriptions are for purposes of illustration only and modifications may be made thereto within the scope of the invention.

The description and drawings illustratively set forth the presently preferred invention embodiment. We intend the description and drawings to describe this embodiment and not to limit the scope of the invention. Obviously, it is possible to modify these embodiments while remaining within the scope of the following claims. Therefore, within the scope of the claims one may practice the invention otherwise than as the description and drawings specifically show and describe.

The invention claimed is:

1. A child safety latch for limiting movement of a first element with respect to a second element, said latch comprising:

a prong assembly secured to the second element, said prong assembly including a prong arm with a terminal end;

a receiving means secured to the first element for capturing the terminal end of said prong, said receiving means including a receiver to receive and capture said terminal end to stop movement of the first element with respect to the second element;

the movement of the first element with respect to the second element is stopped when the first element has moved a specified distance from the second element; by automatic engagement of the receiver of the receiving means with the terminal end, the prong arm being capable of a releasing movement by a user between a first position in which the terminal end is captured by the receiver preventing movement of the first element with respect to the second element and a second position in which the terminal end is released from the receiver permitting movement of the first element with respect to, and further away from, the second element; and the prong arm is resilient and returns to the first position after release by the user such that when the first element is moved back towards the second element, the latch is automatically reactivated such that subsequent movement of the first element away from the second element by the specified distance will result in re-engagement of the terminal end and the receiver, wherein a secondary lock means is provided which is biased to a locked position in which it prevents the movement of the prong arm by the user until the secondary lock means is first moved by the user to an unlocked position, and wherein the secondary lock is arranged on or as a part of the prong arm and releasable by side to side action of a digit of the user and the releasing movement is a subsequent orthogonal downwards movement of the prong arm by the same digit.

2. A child safety lock according to claim 1, wherein the secondary lock is biased to the locked position by a resilient lock spring such that the user may push the secondary lock against the spring to release the prong arm for movement to its second position and such that the spring automatically restores the secondary lock to the locked position when released.

3. A child safety latch according to claim 1, wherein the prong assembly comprises a first leg which is attached to the second element and a second leg comprising the terminal end, which extends in the direction of movement of the first element and resilient spring means are arranged between each leg.

4. A child safety latch according to claim 2, wherein the fixed support means which are fixedly attached to the first element provide movable connection means to the prong assembly at the first leg of the prong assembly.

5. A child safety latch according to claim 1, wherein in the locked position the secondary lock braces against a locking surface on the fixed support means preventing movement of the prong arm and in the unlocked position is moved free of the locking surface so the prong arm may be moved from its first position to its second position.

6. A child safety latch according to claim 1, wherein the secondary lock is slidably movable from the locked position to the unlocked position.

7. A child safety latch according to claim 1, wherein the secondary lock is moveable from the locked position to the unlocked position in a direction which is approximately orthogonal to the movement of the prong arm from its first position to its second position.

8. A child safety latch according to claim 4, wherein the fixed support comprises two parts; a fixing part which is attach to the second element and a support part which is fitted to the fixing part after the fixing part has been securely attached to the second element.

9. A child safety latch according to claim 8, wherein the support part is slidingly attached to the fixing part.

10. A child safety latch according to claim 1, wherein the secondary lock includes a digit engaging means for engagement by the user.

11. A child safety latch according to claim 1, wherein the secondary lock is engageable by the user and slidably moved in a first step to release the prong arm and the prong assembly is arranged to then be free to be moved in a downward direction to release the terminal end from the receiver and permit the second element to be movement with respect to the first element.

12. A child safety latch according to claim 1, wherein the latch is a cabinet latch and the second element is a part of the cabinet frame and the first element is a cabinet door.

13. A child safety latch according to claim 1, wherein the latch is a drawer latch and the second element is a part of the drawer chest frame and the first element is a drawer.

14. A child safety latch according to claim 1, wherein the secondary lock means are provided on the receiver and prevent movement of the terminal end.

15. A child safety latch according to claim 1, wherein the secondary lock means are released by movement of the prong arm in a direction that is orthogonal to the direction required to move the arm from the first position to the second position.

* * * * *